US006851481B2

(12) United States Patent
Vinegar et al.

(10) Patent No.: US 6,851,481 B2
(45) Date of Patent: Feb. 8, 2005

(54) ELECTRO-HYDRAULICALLY PRESSURIZED DOWNHOLE VALVE ACTUATOR AND METHOD OF USE

(75) Inventors: Harold J. Vinegar, Houston, TX (US); Robert Rex Burnett, Katy, TX (US); William Mountjoy Savage, Houston, TX (US); Frederick Gordon Carl, Jr., Houston, TX (US)

(73) Assignee: Shell Oil Company, Houston, TX (US)

( * ) Notice: Subject to any disclaimer, the term of this patent is extended or adjusted under 35 U.S.C. 154(b) by 87 days.

(21) Appl. No.: 10/220,326

(22) PCT Filed: Mar. 2, 2001

(86) PCT No.: PCT/US01/06949

§ 371 (c)(1),
(2), (4) Date: Aug. 29, 2002

(87) PCT Pub. No.: WO01/65061

PCT Pub. Date: Sep. 7, 2001

(65) Prior Publication Data

US 2003/0051881 A1 Mar. 20, 2003

Related U.S. Application Data

(60) Provisional application No. 60/186,531, filed on Mar. 2, 2000.

(51) Int. Cl.[7] ..... E21B 34/00

(52) U.S. Cl. ..... 166/374; 166/66.6; 166/73; 340/855.9

(58) Field of Search ..... 166/374, 73, 66.6, 166/363; 340/853.9, 854.3, 854.4, 854.5, 855.4, 855.8, 855.9

(56) References Cited

U.S. PATENT DOCUMENTS

| | | | | |
|---|---|---|---|---|
| 2,917,004 | A | 12/1959 | Davis et al. | |
| 3,083,771 | A | 4/1963 | Chapman | |
| 3,247,904 | A | 4/1966 | Wakefield, Jr. | |
| 3,427,989 | A | 2/1969 | Bostock et al. | |
| 3,566,963 | A | 3/1971 | Blackledge | 166/189 |
| 3,602,305 | A | 8/1971 | Kisling, III | 116/134 |
| 3,732,728 | A | 5/1973 | Fitzpatrick | |
| 3,793,632 | A | 2/1974 | Still | 340/18 |
| 3,814,545 | A | 6/1974 | Waters | 417/90 |
| 3,837,618 | A | 9/1974 | Juhel | |

(List continued on next page.)

FOREIGN PATENT DOCUMENTS

| | | | |
|---|---|---|---|
| EP | 28296 | 5/1981 | E21B/47/12 |
| EP | 295178 A2 | 12/1988 | E21B/47/12 |
| EP | 339825 | 11/1989 | E21B/47/12 |

(List continued on next page.)

OTHER PUBLICATIONS

Brown.Connolizo and Robertson, West Texas Oil Lifting Short Course and H.W. Winkler, "Misunderstood or overlooked Gas–Lift Design and Equipment Considerations," SPE, p. 351 (1994).

(List continued on next page.)

*Primary Examiner*—David Bagnell
*Assistant Examiner*—Matthew J. Smith

(57) ABSTRACT

A petroleum well having a communication system and a hydraulic system is provided. The petroleum well includes a borehole and a piping structure positioned within the borehole. The communication system supplies a time varying electric current downhole along the piping structure. The hydraulic system, which is positioned downhole proximate the piping structure, receives the time varying current to operate an electric motor. The motor drives a pump which pressurizes hydraulic fluid to selectively drive an actuator. The actuator is operably connected to a downhole device, such as a shutoff valve, and operates the downhole device as the actuator is driven by the pressurized hydraulic fluid.

24 Claims, 6 Drawing Sheets

U.S. PATENT DOCUMENTS

| | | | | | |
|---|---|---|---|---|---|
| 3,980,826 | A | | 9/1976 | Widmer | 178/68 |
| 4,068,717 | A | | 1/1978 | Needham | 166/272 |
| 4,087,781 | A | | 5/1978 | Grossi et al. | 340/18 |
| 4,295,795 | A | | 10/1981 | Gass et al. | 417/111 |
| 4,393,485 | A | | 7/1983 | Redden | 367/25 |
| 4,468,665 | A | | 8/1984 | Thawley et al. | 340/856 |
| 4,545,731 | A | | 10/1985 | Canalizo et al. | 417/86 |
| 4,576,231 | A | | 3/1986 | Dowling et al. | 166/248 |
| 4,578,675 | A | | 3/1986 | MacLeod | 340/855 |
| 4,596,516 | A | | 6/1986 | Scott et al. | 417/58 |
| 4,630,243 | A | | 12/1986 | MacLeod | 367/82 |
| 4,648,471 | A | | 3/1987 | Bordon | 175/4.55 |
| 4,662,437 | A | | 5/1987 | Renfro | 166/65.1 |
| 4,681,164 | A | | 7/1987 | Stacks | 166/304 |
| 4,709,234 | A | | 11/1987 | Forehand et al. | 340/856 |
| 4,738,313 | A | | 4/1988 | McKee | 166/372 |
| 4,739,325 | A | | 4/1988 | MacLeod | 340/854 |
| 4,839,644 | A | | 6/1989 | Safinya et al. | 340/854 |
| 4,852,648 | A | * | 8/1989 | Akkerman et al. | 166/66.4 |
| 4,886,114 | A | | 12/1989 | Perkins et al. | 166/65.1 |
| 4,901,069 | A | | 2/1990 | Veneruso | 340/853 |
| 4,972,704 | A | | 11/1990 | Wellington et al. | 73/155 |
| 4,981,173 | A | | 1/1991 | Perkins et al. | 166/66.4 |
| 5,001,675 | A | | 3/1991 | Woodward | 367/13 |
| 5,008,664 | A | | 4/1991 | More et al. | 340/854 |
| 5,130,706 | A | | 7/1992 | Van Steenwyk | 340/854.6 |
| 5,134,285 | A | | 7/1992 | Perry et al. | 250/269 |
| 5,160,925 | A | | 11/1992 | Dailey et al. | 340/853.3 |
| 5,162,740 | A | | 11/1992 | Jewell | 324/347 |
| 5,172,717 | A | | 12/1992 | Boyle et al. | 137/155 |
| 5,176,164 | A | | 1/1993 | Boyle | 137/155 |
| 5,191,326 | A | | 3/1993 | Montgomery | 340/855.5 |
| 5,230,383 | A | | 7/1993 | Pringle et al. | 166/66.4 |
| 5,246,860 | A | | 9/1993 | Hutchins et al. | 436/27 |
| 5,251,328 | A | | 10/1993 | Shaw | 455/73 |
| 5,257,663 | A | | 11/1993 | Pringle et al. | |
| 5,267,469 | A | | 12/1993 | Espinoza | 73/40.5 |
| 5,278,758 | A | | 1/1994 | Perry et al. | 364/422 |
| 5,331,318 | A | | 7/1994 | Montgomery | 340/855.4 |
| 5,353,627 | A | | 10/1994 | Diatschenko et al. | 73/903 |
| 5,358,035 | A | | 10/1994 | Grudzinski | |
| 5,367,694 | A | | 11/1994 | Ueno | 395/800 |
| 5,394,141 | A | | 2/1995 | Soulier | 340/854.4 |
| 5,396,232 | A | | 3/1995 | Mathieu et al. | 340/854.5 |
| 5,425,425 | A | | 6/1995 | Bankston et al. | 166/377 |
| 5,447,201 | A | | 9/1995 | Mohn | 166/375 |
| 5,458,200 | A | | 10/1995 | Lagerlef et al. | 166/372 |
| 5,467,083 | A | | 11/1995 | McDonald et al. | 340/854.6 |
| 5,473,321 | A | | 12/1995 | Goodman et al. | 340/854.9 |
| 5,493,288 | A | | 2/1996 | Henneuse | 340/854.4 |
| 5,531,270 | A | | 7/1996 | Fletcher et al. | 166/53 |
| 5,561,245 | A | | 10/1996 | Georgi et al. | 73/52.02 |
| 5,574,374 | A | | 11/1996 | Thompson et al. | 324/338 |
| 5,576,703 | A | | 11/1996 | MacLeod, et al. | 340/854.4 |
| 5,587,707 | A | | 12/1996 | Dickie et al. | 340/870.09 |
| 5,592,438 | A | | 1/1997 | Rorden et al. | 367/83 |
| 5,662,165 | A | | 9/1997 | Tubel et al. | 166/250.01 |
| 5,723,781 | A | | 3/1998 | Pruett et al. | 73/152.18 |
| 5,730,219 | A | | 3/1998 | Tubel et al. | 66/250.01 |
| 5,745,047 | A | | 4/1998 | Van Gisbergen et al. | 340/853.1 |
| 5,782,261 | A | | 7/1998 | Becker et al. | 137/155 |
| 5,797,453 | A | | 8/1998 | Hisaw | 166/117.5 |
| 5,881,807 | A | | 3/1999 | Boe et al. | 166/100 |
| 5,883,516 | A | | 3/1999 | Van Steenwyk et al. | 324/366 |
| 5,887,657 | A | | 3/1999 | Bussear et al. | 166/336 |
| 5,896,924 | A | | 4/1999 | Carmody et al. | 166/53 |
| 5,934,371 | A | | 8/1999 | Bussear et al. | 166/53 |
| 5,937,945 | A | | 8/1999 | Bussear et al. | 166/250.15 |
| 5,941,307 | A | | 8/1999 | Tubel | |
| 5,955,666 | A | | 9/1999 | Mullins | 73/52.18 |
| 5,959,499 | A | | 9/1999 | Khan et al. | 330/149 |
| 5,960,883 | A | | 10/1999 | Tubel et al. | 166/313 |
| 5,963,090 | A | | 10/1999 | Fukuchi | 330/149 |
| 5,971,072 | A | | 10/1999 | Huber et al. | |
| 5,975,204 | A | | 11/1999 | Tubel et al. | 166/250.15 |
| 5,995,020 | A | | 11/1999 | Owens et al. | 340/854.9 |
| 6,012,015 | A | | 1/2000 | Tubel | 702/6 |
| 6,012,016 | A | | 1/2000 | Bilden et al. | 702/12 |
| 6,070,608 | A | | 6/2000 | Pringle | 137/155 |
| 6,123,148 | A | | 9/2000 | Oneal | 166/118 |
| 6,148,915 | A | | 11/2000 | Mullen et al. | 166/278 |
| 6,192,983 | B1 | | 2/2001 | Neuroth et al. | 166/250.15 |
| 6,208,586 | B1 | | 3/2001 | Rorden et al. | 367/35 |
| 6,334,486 | B1 | | 1/2002 | Carmody et al. | 166/53 |
| 6,484,800 | B2 | | 11/2002 | Carmody et al. | 166/53 |
| 6,633,236 | B2 | * | 10/2003 | Vinegar et al. | 340/854.4 |

FOREIGN PATENT DOCUMENTS

| | | | | |
|---|---|---|---|---|
| EP | 492856 | A2 | 7/1992 | H04B/1/62 |
| EP | 641916 | A2 | 3/1995 | E21B/33/124 |
| EP | 681090 | A2 | 11/1995 | E21B/47/18 |
| EP | 697500 | A2 | 2/1996 | E21B/49/00 |
| EP | 0 721 053 | A1 | 7/1996 | E21B/47/12 |
| EP | 731053 | A1 | 9/1996 | A21C/9/04 |
| EP | 0 919 696 | A2 | 6/1999 | E21B/47/12 |
| EP | 922835 | A2 | 6/1999 | E21B/43/14 |
| EP | 930518 | A2 | 7/1999 | G01V/3/12 |
| EP | 964134 | A2 | 12/1999 | E21B/47/12 |
| EP | 972909 | A2 | 1/2000 | E21B/44/00 |
| EP | 0 972 909 | A2 | 1/2000 | E21B/44/00 |
| EP | 999341 | A2 | 5/2000 | E21B/33/124 |
| FR | 2677134 | | 12/1992 | E21B/47/12 |
| GB | 2083321 | A | 3/1982 | H04B/5/00 |
| GB | 2325949 | A | 12/1998 | E21B/43/12 |
| GB | 2327695 | A | 2/1999 | E21B/43/12 |
| GB | 2338253 | A | 12/1999 | E21B/47/12 |
| WO | 80/00727 | | 4/1980 | E21B/47/12 |
| WO | 93/26115 | | 12/1993 | H04N/1/40 |
| WO | 96/00836 | | 1/1996 | E21B/47/12 |
| WO | 96/24747 | | 2/1996 | E21B/43/12 |
| WO | 97/16751 | | 5/1997 | G01V/3/00 |
| WO | 97/37103 | | 10/1997 | E21B/47/01 |
| WO | 98/20233 | | 5/1998 | E21B/43/40 |
| WO | 99/60247 | | 5/1999 | E21B/43/12 |
| WO | 99/37044 | | 7/1999 | H04B/13/02 |
| WO | 99/57417 | | 11/1999 | E21B/41/00 |
| WO | 00/04275 | | 1/2000 | E21B/47/01 |
| WO | 00/37770 | | 6/2000 | E21B/37/06 |
| WO | 01/20126 | A2 | 3/2001 | E21B/43/12 |
| WO | 01/55555 | A1 | 8/2001 | E21B/47/12 |

OTHER PUBLICATIONS

Der Spek, Alex, and Aliz Thomas, "Neural–Net Identification of Flow Regime with Band Spectra of Flow–Generated Sound", SPE Reservoir Eva. & Eng.2 (6) Dec. 1999, pp. 489–498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993,, pps. 102–106.

Otis Engineering, Aug. 1980, "Heavy Crude Lift System", Field Development Report, OEC 5228, Otis Corp., Dallas, Texas, 1980.

* cited by examiner

ELECTRO-HYDRAULICALLY PRESSURIZED DOWNHOLE VALVE ACTUATOR AND METHOD OF USE

CROSS-REFERENCES TO RELATED APPLICATIONS

This application claims the benefit of prov. application 60/186,531, filed on Mar. 2, 2000.

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |

-continued

COMMONLY OWNED AND PREVIOUSLY FILED U.S. PROVISIONAL PATENT APPLICATIONS

| T&K # | Ser. No. | Title | Filing Date |
|---|---|---|---|
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S. PATENT APPLICATIONS

| T&K # | Ser. No. | Title | Filing Date |
|---|---|---|---|
| TH 1601 | 10/220,254 | Reservoir Production Control from Intelligent Well Data | Aug. 29, 2002 |
| TH 1671 | 10/220,251 | Tracer Injection in a Production Well | Aug. 29, 2002 |
| TH 1672 | 10/220,402 | Oilwell Casing Electrical Power Pick-Off Points | Aug. 29, 2002 |
| TH 1673 | 10/220,252 | Controllable Production Well Packer | Aug. 29, 2002 |
| TH 1674 | 10/220,249 | Use of Downhole High Pressure Gas in a Gas Lift Well | Aug. 29, 2002 |
| TH 1675 | 10/220,195 | Wireless Smart Well Casing | Aug. 29, 2002 |
| TH 1677 | 10/220,253 | Method for Dowuhole Power Management Using Energization from Distributed Batteries or Capacitors with Reconfigurable Discharge | Aug. 29, 2002 |
| TH 1679 | 10/220,453 | Wireless Downhole Well Interval Inflow and Injection Control | Aug. 29, 2002 |
| TH 1705 | 10/220,455 | Wireless Downhole Measurement and Control For Optimizing Gas Lift Well and Field Performance | Aug. 29, 2002 |
| TH 1722 | 10/220,372 | Controlled Downhole Chemical Injection | Aug. 30, 2002 |
| TH 1723 | 10/220,652 | Wireless Power and Communications Cross-Bar Switch | Aug. 29, 2002 |

The current application shares some specification and figures with the following commonly owned and previously filed applications, all of which are hereby incorporated by reference:

COMMONLY OWNED AND PREVIOUSLY FILED U.S. PATENT APPLICATIONS

| | Ser. No. | Title | Filing Date |
|---|---|---|---|
| TH 1599US | 09/769,047 | Toroidal Choke Inductor for Wireless Communication and Control | Oct. 20, 2003 |
| TH 1600US | 09/769,048 | Induction Choke for Power Distribution in Piping Structure | Jan. 24, 2001 |
| TH 1602US | 09/768,705 | Controllable Gas-Lift Well and Valve | Jan. 24, 2001 |

-continued

| COMMONLY OWNED AND PREVIOUSLY FILED U.S. PATENT APPLICATIONS | | | |
|---|---|---|---|
| | Ser. No. | Title | Filing Date |
| TH 1603US | 09/768,655 | Permanent Downhole, Wireless, Two-Way Telemetry Backbone Using Redundant Repeater | Jan. 24, 2001 |
| TH 1668US | 09/768,046 | Petroleum Well Having Downhole Sensors, Communication, and Power | Jan. 24, 2001 |
| TH 1669US | 09/768,656 | System and Method for Fluid Flow Optimization | Jan. 24, 2001 |
| TS 6185 | 09/779,935 | A Method and Apparatus for the Optimal Predistortion of an Electro Magnetic Signal in a Downhole Communications System | Feb. 8, 2001 |

The benefit of 35 U.S.C. § 120 is claimed for all of the above referenced commonly owned applications. The applications referenced in the tables above are referred to herein as the "Related Applications."

BACKGROUND OF THE INVENTION

1. Field of the Invention

The present invention relates generally to petroleum wells and in particular to petroleum wells having a communication system for delivering power and communications to a downhole hydraulic system, the hydraulic system being operably connected to a downhole device for operating the downhole device.

2. Description of Related Art

Several methods have been devised to place electronics, sensors, or controllable valve downhole along an oil production tubing string, but all such known devices typically use a internal or external cable along the tubing string to provide power and communications downhole. It is, of course, highly undesirable and in practice difficult to use a cable along the tubing string either integral to the tubing string or spaced in the annulus between the tubing string and the casing. The use of a cable presents difficulties for well operators while assembling and inserting the tubing string into a borehole. Additionally, the cable is subjected to corrosion and heavy wear due to movement of the tubing string within the borehole. An example of a downhold communication system using a cable is shown in PCT/EP97/01621.

U.S. Pat. No. 4,839,644 describes a method and system for wireless two-way communications in a cased borehole having a tubing string. However, this system describes communication scheme for coupling electromagnetic energy in a TEM mode using the annulus between the casing and the tubing. This inductive coupling requires a substantially nonconductive fluid such as crude oil in the annulus between the casing and the tubing. Therefore, the invention described in U.S. Pat. No. 4,839,644 has not been widely adopted as a practical scheme for downhole two-way communication. Another system for downhole communication using mud pulse telemetry is described in U.S. Pat. Nos. 4,648,471 and 5,887,657. Although mud pulse telemetry can be successful at low data rates, it is of limited usefulness where high data rates are required or where it is undesirable to have complex, mud pulse telemetry equipment downhole. Other methods of communicating within a borehole are described in U.S. Pat. Nos. 4,468,665; 4,578,675; 4,739,325; 5,130,706; 5,467,083; 5,493,288; 5,576,703; 5,574,374; and 5,883,516. Similarly, several permanent downhole sensors and control systems have been described in U.S. Pat. Nos. 4,972,704; 5,001,675; 5,134,285; 5,278,758; 5,662,165; 5,730,219; 5,934,371; and 5,941,307.

The Related Applications describe methods for providing electrical power and communications to various downhole devices in petroleum wells. These methods use either the production tubing as a supply and the casing as a return for the power and communications transmission circuit, or alternatively, the casing as the supply with a formation ground as the return. In either configuration, electrical losses in the transmission circuit are highly variable, depending on the specific conditions for a particular well. Power supplied along the casing with a formation ground as the return is especially susceptible to current losses. Electric current leakage generally occurs through the completion cement into the earthen formation. The more conductive the cement and earthen formation, the greater the current loss as the current travels along the casing.

A need therefore exists to accommodate power losses which will be experienced when using a downhole wireless communication system. Since these losses place limits on the available amount of instantaneous electrical power, a need also exists for a system and method of storing energy for later use with downhole devices, especially high energy devices such as emergency shutoff valves, or other safety equipment. Although one solution to downhole energy storage problems could be provided by electrical storage such as capacitors, or chemical storage such as batteries, the limited lifetimes of such devices makes the use of the devices less than ideal in an operating petroleum well.

All references cited herein are incorporated by reference to the maximum extent allowable by law. To the extent a reference may not be filly incorporated herein, it is incorporated by reference for background purposes and indicative of the knowledge of one of ordinary skill in the art.

BRIEF SUMMARY OF THE INVENTION

The problems presented in accommodating energy losses along a transmission path and in providing a usable source of instantaneous downhole energy are solved by the systems and methods of the present invention. In accordance with one embodiment of the present invention, a method for operating a downhole device in a borehole of a petroleum well is provided. The petroleum well includes a piping structure positioned within the borehole of the well. The method includes delivering a time-varying current along the piping structure, the current being used to operate a motor. The motor drives a pump, which performs the step of pressuring a hydraulic fluid. Finally, the step of operating the downhole device is accomplished using the pressurized hydraulic fluid.

In another embodiment of the present invention, a petroleum well having a borehole and a piping structure positioned within the borehole is provided. The petroleum well includes a communications system and a hydraulic system. The communications system is operably associated with the piping structure of the well and transmits a time varying current along the piping structure. The hydraulic system is electrically connected to the piping structure and is configured to operate a downhole device.

In another embodiment of the present invention, a hydraulic actuation system includes a motor that is configured to receive a time varying current along a pipe member. A pump is operably connected to and is driven by the motor such that the pump pressurizes a hydraulic fluid. An actuator is hydraulically connected to the pump and is selectively driven by the pressurized hydraulic fluid supplied by the pump. The actuator is configured for operable attachment to a target device, the actuator operating the target device as the actuator is driven by the pressurized hydraulic fluid.

DETAILED DESCRIPTION OF THE PREFERRED EMBODIMENT

Figure 1:
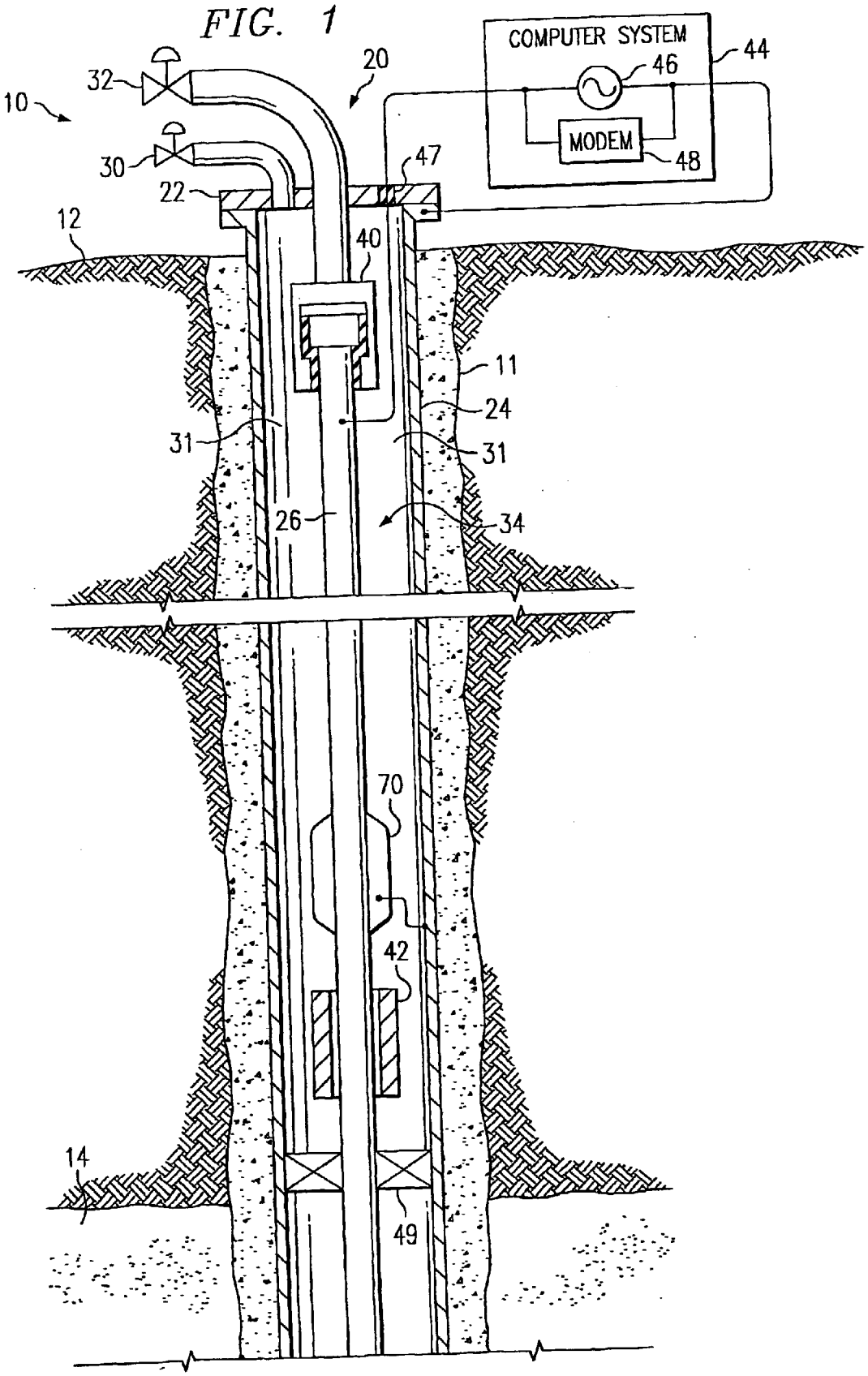
FIG. 1 is a schematic of a petroleum well having a wireless communication system and a hydraulic pressure system according to the present invention.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other structures known to one of ordinary skill in the art. The preferred embodiment makes use of the invention in the context of an oil well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from one location where a power source is electrically connected to another location where a device and/or electrical return is electrically connected. The piping structure will typically be conventional round metal tubing, but the cross-sectional geometry of the piping structure, or any portion thereof, can vary in shape (e.g., round, rectangular, square, oval) and size (e.g., length, diameter, wall thickness) along any portion of the piping structure.

A "valve" is any device that functions to regulate the flow of a fluid. Examples of valves include, but are not limited to, bellows-type gas-lift valves and controllable gas-lift valves, each of which may be used to regulate the flow of lift gas into a tubing string of a well. The internal workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. Valves generally fall into one or the other of two classes: regulating valves intended to regulate flow continuously over a dynamic range from fully closed to fully open, and valves intended to be operated only fully open or fully closed, with intermediate positions considered transient. The latter class of valves may be operated to protect personnel or equipment during scheduled maintenance or modification, or may form part of the emergency shut-in system of a well, in which case they must be capable of operating rapidly and without lengthy preparation Subsurface safety valves are an example of this type of valve. Valves can be mounted downhole in a well in many different ways, some of which include tubing conveyed mounting configurations, side-pocket mandrel configurations, or permanent mounting configurations such a mounting the valve in an enlarged tubing pod.

The term "modem" is used generically herein to refer to any communications device for transmitting and/or receiving electrical communication signals via an electrical conductor (e.g., metal). Hence, the term is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog-to-digital conversion is needed. As another example, a relay/slave modem or communication device may only need to identify, filter, amplify, and/or retransmit a signal received.

The term "processor" is used in the present application to denote any device that is capable of performing arithmetic and/or logic operations. The processor may optionally include a control unit, a memory unit, and an arithmetic and logic unit.

The term "sensor" as used in the present application refers to any device that detects, determines, monitors, records, or otherwise senses the absolute value of or a change in a physical quantity. Sensors as described in the present application can be used to measure temperature, pressure (both absolute and differential), flow rate, seismic data, acoustic data, pH level, salinity levels, valve positions, or almost any other physical data.

As used in the present application, "wireless" means the absence of a conventional, insulated wire conductor e.g. extending from a downhole device to the surface. Using the tubing and/or casing as a conductor is considered "wireless."

The term "electronics module" in the present application refers to a control device. Electronics modules can exist in many configurations and can be mounted downhole in many different ways. In one mounting configuration, the electronics module is actually located within a valve and provides control for the operation of a motor within the valve. Electronics modules can also be mounted external to any particular valve. Some electronics modules will be mounted within side pocket mandrels or enlarged tubing pockets, while others may be permanently attached to the tubing string. Electronics modules often are electrically connected to sensors and assist in relaying sensor information to the surface of the well. It is conceivable that the sensors associated with a particular electronics module may even be packaged within the electronics module. Finally, the electronics module is often closely associated with, and may actually contain, a modem for receiving, sending, and relaying communications from and to the surface of the well. Signals that are received from the surface by the electronics module are often used to effect changes within downhole controllable devices, such as valves. Signals sent or relayed to the surface by the electronics module generally contain information about downhole physical conditions supplied by the sensors.

In accordance with conventional terminology of oilfield practice, the descriptors "upper," "lower," "uphole," and "downhole" as used herein are relative and refer to distance along hole depth from the surface, which in deviated or horizontal wells may or may not accord with vertical elevation measured with respect to a survey datum.

Referring to FIG. 1 in the drawings, a petroleum well 10 according to the present invention is illustrated. Petroleum well 10 includes a borehole 11 extending from a surface 12 into a production zone 14 located downhole. A production platform 20 is located at surface 12 and includes a hanger 22 for supporting a casing 24 and a tubing string 26. Casing 24 is of the type conventionally employed in the oil and gas industry. The casing 24 is typically installed in sections and is cemented in borehole 11 during well completion. Tubing string 26, also referred to as production tubing, is generally conventional comprising a plurality of elongated tubular pipe sections joined by threaded couplings at each end of the pipe sections. Production platform 20 also includes a gas input throttle 30 to permit the input of compressed gas into an annular space 3 between casing 24 and tubing string 26. Conversely, output valve 32 permits the expulsion of oil and gas bubbles from an interior of tubing string 26 during oil production.

Petroleum well 10 includes a communication system 34 for providing power and two-way communications downhole in well 10. Communication system 34 includes a lower induction choke 42 that is installed on tubing string 26 to act as a series impedance to electric current flow. The size and material of lower induction choke 42 can be altered to vary the series impedance value; however, the lower induction choke 42 is made of a ferromagnetic material. Induction choke 42 is mounted concentric and external to tubing string 26, and is typically hardened with epoxy to withstand rough handling.

An insulating tubing joint 40 (also referred to as an electrically insulating joint) is positioned on tubing string 26 near the surface of the well. Insulating tubing joint 40, along with lower induction choke 42, provide electrical isolation for a section of tubing string 26 located between insulating tubing joint 40 and induction choke 42. The section of tubing string 26 between insulating tubing joint 40 and lower choke 42 may be viewed as a power and communications path. In alternative to or in addition to the insulating tubing joint 40, an upper induction choke (not shown) can be placed about the tubing string 26 or an insulating tubing hanger (not shown) could be employed.

A computer and power source 44 including a power supply 46 and a spread spectrum communications device 48 (e.g. modem) is disposed outside of borehole 11 at surface 12. The computer and power source 44 is electrically connected to tubing string 26 below insulating tubing joint 40 for supplying time varying current to the tubing string 26. A return feed for the current is attached to casing 24. In operation the use of tubing string 26 as a conductor is fairly lossy because of the often great lengths of tubing string along which current is supplied. However, the spread spectrum communications technique is tolerant of noise and low signal levels, and can operate effectively even with losses as high as −100 db.

The method of electrically isolating a section of the tubing string as illustrated in FIG. 1 is not the sole method of providing power and communications signals downhole. In the preferred embodiment of FIG. 1, power and communication signals are supplied on tubing string 26, with the electrical return being provided by casing 24. Instead, the electrical return could be provided by an earthen ground. An electrical connection to earthen ground could be provided by passing a wire through casing 24 or by connecting the wire to the tubing string below lower choke 42 (if the lower portion of the tubing string was grounded).

An alternative power and communications path could be provided by casing 24. In a configuration similar to that used with tubing string 26, a portion of casing 24 could be electrically isolated to provide a telemetry backbone for transmitting power and communication signals downhole. If induction chokes were used to isolate a portion of casing 24, the chokes would be disposed concentrically around the outside of the casing. Instead of using chokes with the casing 24, electrically isolating connectors could be used similar to insulating tubing joint 40. In embodiments using casing 24 to supply power and communications signals downhole, an electrical return could be provided either via the tubing string 26 or via an earthen ground.

A packer 49 is placed within casing 24 below lower induction choke 42. Packer 49 is located above production zone 14 and serves to isolate production zone 14 and to electrically connect metal tubing string 26 to metal casing 24. Typically, the electrical connections between tubing string 26 and casing 24 would not allow electrical signals to be transmitted or received up and down borehole 11 using tubing string 26 as one conductor and casing 24 as another conductor However, the disposition of insulating tubing joint 40 and lower induction choke 42 create an electrically isolated section of the tubing string 26, which provides a system and method to provide power and communication signals up and down borehole 11 of petroleum well 10.

Figure 2:
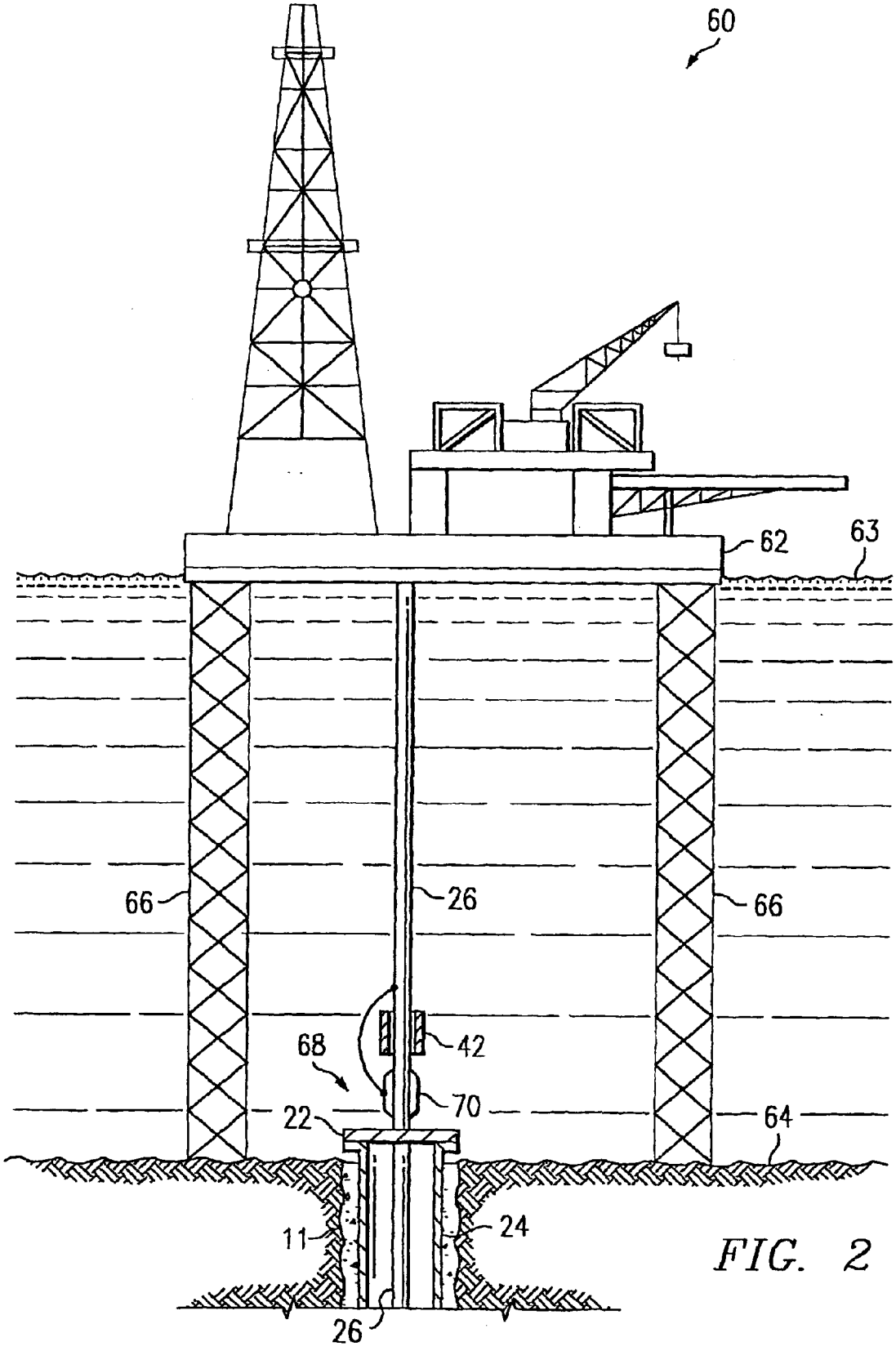
FIG. 2 is a schematic of an offshore petroleum well having a wireless communication system and a hydraulic pressure system according to the present invention.

Referring to FIG. 2 in the drawings, an offshore petroleum well 60 is illustrated. Petroleum well 60 includes a main production platform 62 at an aqueous surface 63 anchored to a earthen floor 64 with support members 66. Petroleum well 60 has many similarities to petroleum well 10 of FIG. 1. The borehole 11 of petroleum well 60 begins at earthen floor 64. Casing 24 is positioned within borehole 11, and tubing hanger 22 provides downhole support for tubing string 26. One of the primary differences between petroleum well 10 and petroleum well 60 is that tubing string 26 in petroleum well 60 extends through water 67 before reaching borehole 11.

Induction choke 42 is positioned on tubing string 26 just above a wellhead 68 at earthen floor 64. An insulating tubing joint (similar to insulating tubing joint 40, but not shown) is provided at a portion of the tubing string 26 on production platform 62. Time varying current is imparted to a section of tubing string 26 between the insulating tubing joint and induction choke 42 to supply power and communications at wellhead 68.

A person skilled in the art will recognize that under normal circumstances a short circuit would occur for current passed along tubing string 26 since the tubing string is surrounded by electrically conductive sea water. However, corrosion inhibiting coatings on tubing string 26 are generally non-conductive and can provide an electrically insulating "sheath" around the tubing string, thereby allowing current transfer even when tubing string 26 is immersed in water. In an alternative arrangement, power could be supplied to wellhead 68 by an insulated cable (not shown) and then supplied downhole in the same manner provided in petroleum well 10. In such an arrangement, the insulating tubing joint and induction choke 42 would be positioned within the borehole 11 of petroleum well 60.

Figure 3:
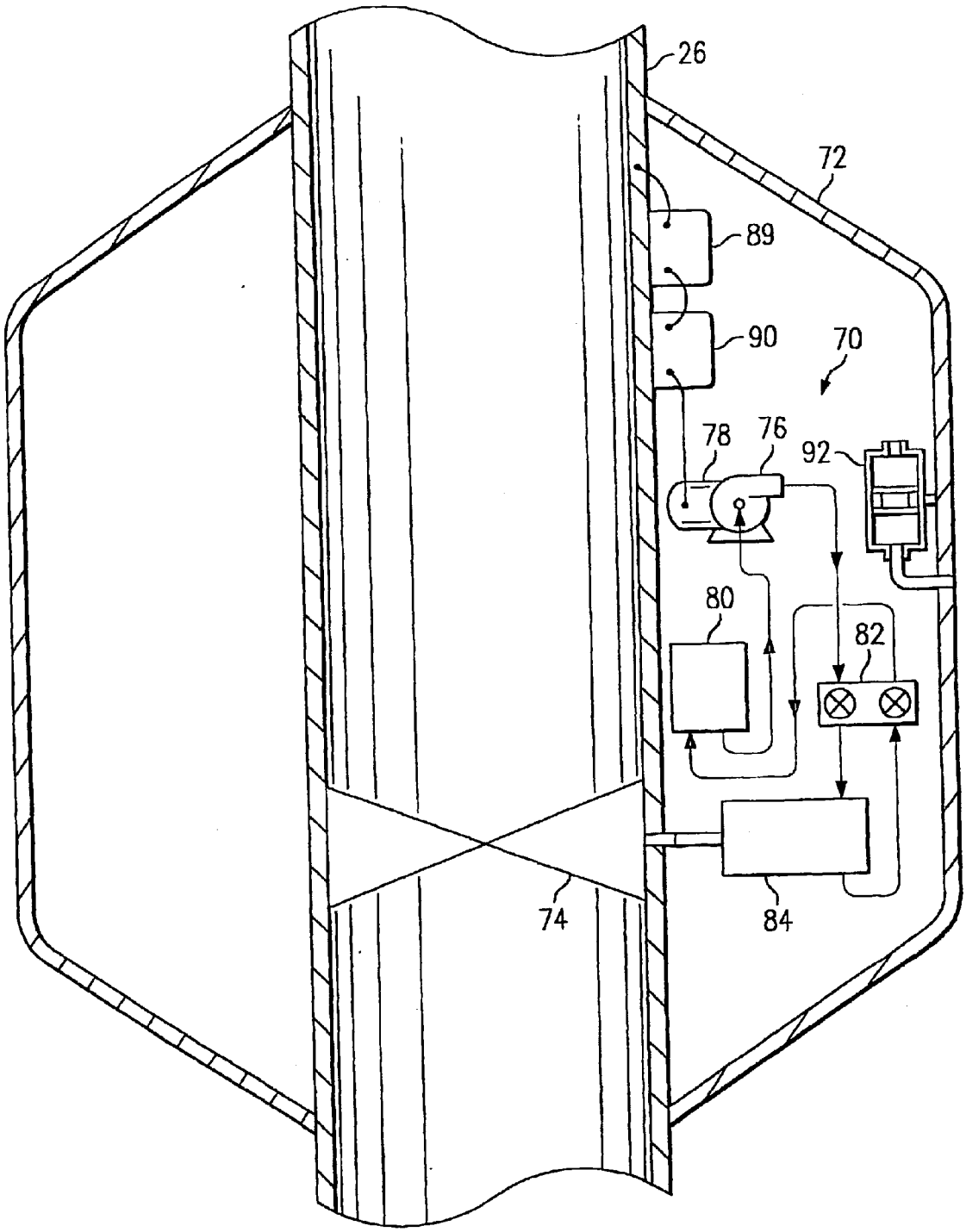
FIG. 3 is an enlarged schematic of a piping structure of a petroleum well, the piping structure having an enlarged pod that houses a hydraulic pressure system according to the present invention.

Referring still to FIG. 2, but also to FIGS. 1 and 3 in the drawings, a hydraulic system 70 provided for operating a downhole device, or a target device (not shown). Hydraulic system 70 is disposed within an enlarged pod 72 on tubing string 26. In FIG. 3 the downhole device is a shut-off valve 74; however, a number of different downhole devices could be operated by hydraulic system 70. Shut-off valve 74 is driven incrementally by hydraulic fluid pressurized by a pump 76. An electric motor 78 is powered by time varying current passed along tubing string 26. Motor 78 is operably connected to pump 76 for driving the pump 76. The electric motor 78 driving hydraulic pump 76 consumes small amounts of power such that it may operate with the limited power available at depth in the well. By appropriate design of hydraulic pump 76 and other components of hydraulic system 70, especially in the design of seals that minimize hydraulic fluid leakage in these components, the low amount of available power does not restrict the hydraulic pressure that can be generated, but rather restricts the flow rate of the hydraulic fluid.

Figure 4:
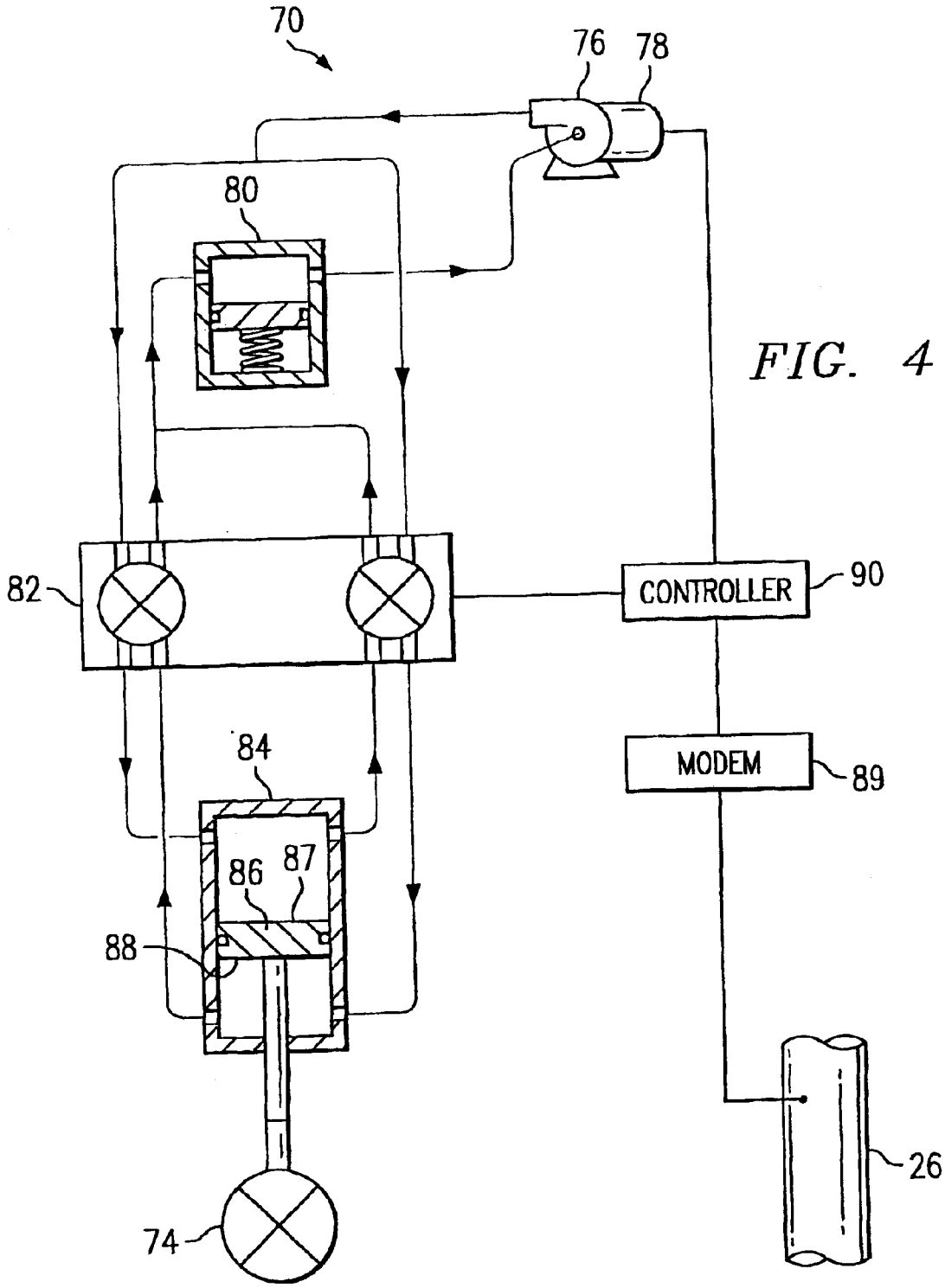
FIG. 4 is an electrical and plumbing schematic of the hydraulic pressure system of FIG. 3.

Referring now to FIG. 4 in the drawings, the plumbing and electrical connections for hydraulic system 70 are illustrated in more detail. In addition to pump 76 and motor 78, hydraulic system 70 includes a fluid reservoir 80, a pilot valve 82, a valve actuator 84, and the necessary tubing and hardware to route hydraulic fluid between these components. Reservoir 80 is hydraulically connected to pump 76 for supplying hydraulic fluid to the pump 76. Pilot valve 82 is hydraulically connected to pump 76, actuator 84, and reservoir 80. Pilot valve 82 selectively routes pressurized hydraulic fluid to actuator 84 for operating the actuator 84. Actuator 84 includes a piston 86 having a first side 87 and a second side 88. Piston 86 is operably connected to valve 74 for opening and closing the valve 74. By selectively routing pressurized hydraulic fluid to different sides of piston 86, valve 74 can be selectively opened or closed. For example, in one configuration, hydraulic fluid might be routed to a chamber just above first side 87 of piston 86. The pressurized fluid would exert a force on piston 86, causing the piston 86 to move downward, thereby closing valve 74. Fluid in a chamber adjacent the second side 88 of piston 86 would be displaced into reservoir 80. In this configuration, valve 74 could be opened by adjusting pilot valve 82 such that pressurized hydraulic fluid is supplied to the chamber adjacent the second side 88 of piston 86. The pressurized fluid would exert an upward force on piston 86, thereby moving piston 86 upward and opening valve 74. Displaced hydraulic fluid in the chamber adjacent front side 87 would be routed to reservoir 80.

As previously mentioned, electric current is supplied to motor 78 along tubing string 26. A modem 89 is positioned within enlarged pod 72 for receiving signals from modem 48 at surface 12. Modem 89 is electrically connected to a controller 90 for controlling the operation of motor 78. Controller 90 is also electrically connected to pilot valve 82 for controlling operation of the pilot valve, thereby insuring that the valve properly routes hydraulic fluid from the pump 76 to the actuator 84 and the reservoir 80.

In operation, electric current is supplied downhole along tubing string 26 and is received by modem 89. Controller 90 receives instructions from modem 89 and routes power to motor 78. Controller 90 also establishes the setting for pilot valve 82 so that hydraulic fluid is properly routed throughout the hydraulic system 70. As motor 78 is powered, it drives pump 76 which draws hydraulic fluid from reservoir 80. Pump 76 pressurizes the hydraulic fluid, pushing the fluid into pilot valve 82. From pilot valve 82, the pressurized hydraulic fluid is selectively routed to one side of piston 86 to drive the actuator 84. Depending on the side of piston 86 to which fluid was delivered, valve 74 will be opened or closed. As the piston 86 moves, displaced hydraulic fluid is routed from actuator 84 to reservoir 80.

Hydraulic system 70 may also include a bottom hole pressure compensator 92 (see FIG. 3) to balance the static pressure of the hydraulic fluid circuit against the static pressure of downhole fluids in the well. Use of a pressure compensator minimizes differential pressure across any rotary or sliding seals between the hydraulic circuit and the well fluids if these seals are present in the design, and thus minimizes stress on such seals.

Enlarged pod 72 is filled with oil, the pressure of which is balanced with the pressure of any fluid present in annulus 31. By porting one side of the pressure compensator 92 to the exterior of pod 72, the pressure of oil within the enlarged pod 72 can be matched to the pressure of fluid within the annulus 31. The adjustment of internal pod pressure allows many of the components of the hydraulic system 70 to operate more efficiently.

Figure 5:
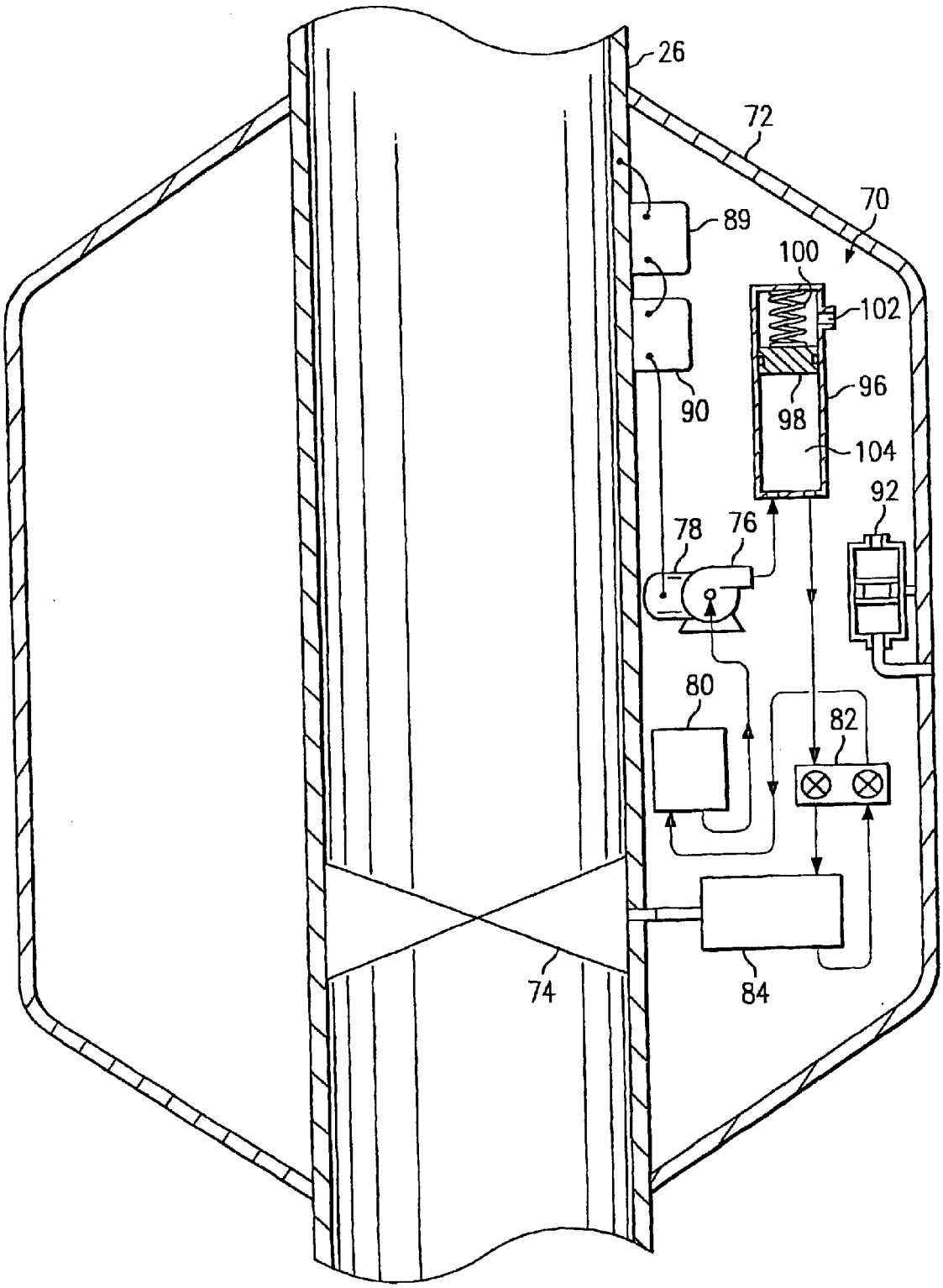
FIG. 5 is an enlarged schematic of a piping structure of a petroleum well, the piping structure having an enlarged pod that houses a hydraulic adjustment system according to an alternate embodiment of the present invention.
Figure 6:
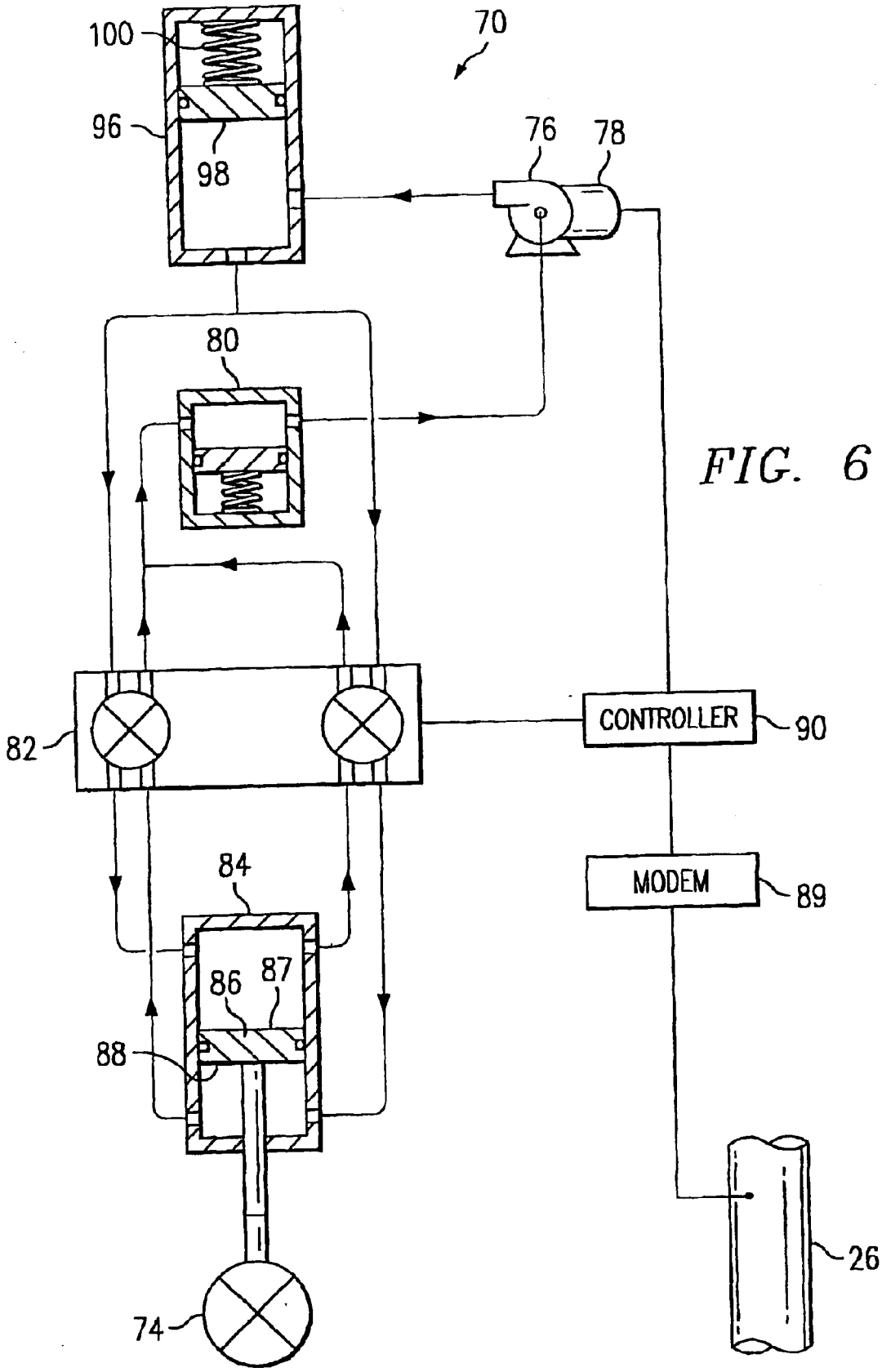
FIG. 6 is an electrical and plumbing schematic of the hydraulic adjustment system of FIG. 5.

Referring now to FIGS. 5 and 6 in the drawings, an alternate embodiment for hydraulic system 70 is illustrated. The components for this hydraulic system are substantially similar to those illustrated in FIGS. 3 and 4. In this particular embodiment, however, an accumulator 96 is hydraulically connected between pump 76 and pilot valve 82 for collecting pressurized hydraulic fluid supplied by the pump 76. The control of hydraulic system 70 is identical to that previously described, except that accumulator 96 is now used to supply the pressurized hydraulic fluid to actuator 84. Accumulator 96 allows instantaneous hydraulic operations to be intermittently performed (e.g. quick opening or closing of a valve). This is in contrast to the previous embodiment, which used a pump to supply hydraulic fluid to the actuator 84 more gradually.

Accumulator 96 includes a piston 98 slidingly and sealingly disposed within a housing, the piston being biased in one direction by a spring 100. A compensator port 102 is disposed in the housing and allows pressurized oil within enlarged pod 72 to exert an additional force on piston 9 which is complementary to the force exerted by spring 100. Motor 78 and pump 76 charge accumulator 96 to a high pressure by pushing hydraulic fluid into a main chamber 104 against the biased piston 98. When the force exerted by hydraulic fluid within main chamber 104 equals the forces on the opposite side of piston 98, pump 76 ceases operation, and the hydraulic fluid is stored within accumulator 96 until needed.

The stored, pressurized hydraulic fluid is released under control of pilot valve 82 to drive actuator 84 and thus actuate the main valve 74. Because of the energy stored in the accumulator 96, valve 74 can be opened or closed immediately upon receipt of an open or close command. Accumulator 96 is sized to enable at least one complete operation (open or close) of valve 74. Thus the methods of the present invention provide for the successful operation of valves which require transient high transient power, such as subsurface safety valves.

It will be clear that a variety of hydraulic devices may be substituted for shutoff valve 74, which has been described for illustrative purposes only. It should also be clear that communication system 34 and hydraulic system 70 provided by the present invention, while located on tubing string 26 in the preceding description, could be disposed on casing 24 of the well, or any other piping structure associated with the well.

Even though many of the examples discussed herein are applications of the present invention in petroleum wells, the present invention also can be applied to other types of wells, including but not limited to water wells and natural gas wells.

One skilled in the art will see that the present invention can be applied in many areas where there is a need to provide a communication system and a hydraulic system within a borehole, well, or any other area that is difficult to access. Also, one skilled in the art will see that the present invention can be applied in many areas where there is an already existing conductive piping structure and a need to route power and communications to a hydraulic system located proximate the piping structure. A water sprinkler system or network in a building for extinguishing fires is an example of a piping structure that may be already existing and may have same or similar path as that desired for routing power and communications to a hydraulic system. In such case another piping structure or another portion of the same piping structure may be used as the electrical return. The steel structure of a building may also be used as a piping structure and/or electrical return for transmitting power and communications to a hydraulic system in accordance with the present invention. The steel rebar in a concrete dam or a street may be used as a piping structure and/or electrical return for transmitting power and communications to a hydraulic system in accordance with the present invention. The transmission lines and network of piping between wells or across large stretches of land may be used as a piping structure and/or electrical return for transmitting power and communications to a hydraulic system in accordance with the present invention. Surface refinery production pipe networks may be used as a piping structure and/or electrical return for transmitting power and communications in accordance with the present invention. Thus, there are numerous applications of the present invention in many different areas or fields of use.

It should be apparent from the foregoing that an invention having significant advantages has been provided. While the invention is shown in only a few of its forms, it is not just limited but is susceptible to various changes and modifications without departing from the spirit thereof.

We claim:

1. A method of operating a downhole device in a petroleum well having a borehole and a piping structure positioned within the borehole, comprising the steps of:

delivering a time varying current along the piping structure to a downhole location;

pressurizing a hydraulic fluid using the time varying current at the downhole location;

operating the downhole device using the pressurized hydraulic fluid;

operating a motor at the downhole location;

driving a pump with said motor to pressurize the hydraulic fluid;

providing an actuator operably connected to the downhole device and hydraulically connected to the pump selectively driving the actuator with the pressurized hydraulic fluid such that the downhole device is actuated providing a pilot valve hydraulically connected between the pump and the actuator; and adjusting the pilot valve to selectively drive the actuator.

2. The method according to claim 1 wherein the delivering step further comprising: impeding the time-varying current on the piping structure to define a conductive section; and routing the time varying current along the conductive section of the piping structure.

3. The method according to claim 1 further comprising the step of: storing hydraulic fluid in a reservoir; and drawing hydraulic fluid from the reservoir.

4. The method according to claim 1 further comprising the steps of: collecting pressurized hydraulic fluid in an accumulator; and selectively releasing pressurized hydraulic fluid from the accumulator to operate the downhole device.

5. The method according to claim 1 further comprising: collecting pressurized hydraulic fluid in an accumulator; providing an actuator operably connected to the downhole device and hydraulically connected to the accumulator; and selectively releasing pressurized hydraulic fluid from the accumulator to drive the actuator, thereby operating the downhole device.

6. The method according to claim 5 wherein the step of selectively releasing further comprises: providing a pilot valve hydraulically connected between the accumulator and the actuator; and adjusting the pilot valve to selectively drive the actuator.

7. The method according to claim 1 further comprising the steps of: impeding the time varying current on the piping structure; routing the time varying current along the piping structure to the downhole location; providing an actuator operably connected to the downhole device and hydraulically connected to a pump; and selectively operating a pilot valve hydraulically connected between the pump and the actuator to drive the actuator, thereby operating the downhole device.

8. The method according to claim 7 wherein the downhole device is a main valve and the actuator opens and closes the main valve.

9. The method according to claim 1 further comprising the steps of: impeding the time varying current on the piping structure; routing the time varying current along the piping structure; collecting pressurized hydraulic fluid in an accumulator; providing an actuator operably connected to the downhole device and hydraulically connected to the accumulator; and selectively operating a pilot valve hydraulically connected between the accumulator an, the actuator to drive the actuator, thereby operating the downhole device.

10. The method according to claim 9 wherein the downhole device is a main valve and the actuator opens and closes the main valve.

11. A petroleum well having a borehole and a piping structure positioned within the borehole comprising: a communications system operably associated with the piping structure for transmitting a time varying signal along the piping structure; and a hydraulic system electrically connected to the piping structure and configured for connection to a downhole device, wherein the hydraulic system is configured to receive power from said time varying signal and to operate the downhole device wherein the hydraulic system further comprises: a motor for receiving the time varying current from the piping structure; a pump for selectively pressurizing a hydraulic fluid, the pump being operably connected to and driven by the motor; a pilot valve hydraulically connected to the downhole device; and wherein the pilot valve selectively routes pressurized hydraulic fluid to the actuator, thereby driving the actuator and operating the downhole device.

12. The petroleum well of claim 11 wherein the time varying signal includes a communications signal to selectively operate the downhole device.

13. The petroleum well of claim 11 wherein the communication system further comprises: an impedance device positioned around the piping structure to define a conducting portion; and wherein the time varying current is passed along the conducting portion of the piping structure.

14. The petroleum well of claim 11 wherein the downhole device is a downhole emergency shutoff valve.

15. The petroleum well of claim 11 wherein the hydraulic system further comprises: a motor for receiving the time varying current from the piping structure; a pump for selectively pressurizing a hydraulic fluid, the pump being operably connected to and driven by the motor; an actuator hydraulically connected to the pump and operably connected to the downhole device; and wherein the pressurized hydraulic fluid is used to drive the actuator, thereby operating the downhole device.

16. The petroleum well of claim 11, wherein the downhole device is a valve.

17. The petroleum well of claim 11 wherein the hydraulic system further comprises: a motor for receiving the time varying current from the piping structure; a pump for selectively pressurizing a hydraulic fluid, the pump being operably connected to and drive by the motor; an accumulator hydraulically connected to the pump for collecting pressurized hydraulic fluid; an actuator hydraulically connected to the accumulator and operably connected to the downhole device; and wherein the pressurized hydraulic fluid supplied by the accumulator drives the actuator thereby operating the downhole device.

18. A petroleum well having a borehole and a piping structure positioned within the borehole comprising; a communications system operably associated with the piping structure for transmitting a time varying signal along the piping structure; and a hydraulic system electronically connected to the piping structure and configured for connection to a downhole device, wherein the hydraulic system is configured to receive power from said time varying signal and to operate the downhole device wherein the hydraulic system further comprises: a motor for receiving the time varying current from the piping structure; a pump for selectively pressurizing a hydraulic fluid, the pump being operably connected to and driven by the motor; an accumulator hydraulically connected to the pump for collecting pressurized hydraulic fluid; a pilot valve hydraulically connected to the accumulator; an actuator hydraulically connected to the pilot valve and operably connected to the downhole the device; and wherein the pilot valve selectively routes pressurized hydraulic fluid to the actuator, thereby driving the actuator and operating the downhole device.

19. A hydraulic actuation system comprising: a motor configured to receive a time varying signal delivered along a piping structure; a pump for pressurizing a hydraulic fluid, the pump being operably connected to and being driven by the motor; an actuator hydraulically connected to the pump and configured for operable attachment to target device; and a pilot valve hydraulically connected between the pump and the actuator, wherein the pilot valve selectively routes pressurized hydraulic fluid to the actuator, and wherein the actuator is selectively driven by the pressurized hydraulic fluid, thereby operating the target device.

20. The hydraulic actuation system according to claim 19, including: an impedance device positioned around the piping structure to define a conducting portion; and wherein the time varying current is passed along the conducting portion of the piping structure.

21. The hydraulic actuation system according to claim 19, wherein the time varying signal includes a communications signal to selectively operate said target device.

22. The hydraulic actuation system according to claim 19, further comprising an accumulator hydraulically connected to the pump for collecting pressurized hydraulic fluid.

23. A hydraulic actuation system comprising; a motor configured to receive a time varying signal delivered along a piping structure; a pump for pressurizing a hydraulic fluid, the pump being operably connected to and being driven by the motor an actuator hydraulically connected to the pump and configured for operable attachment to a target device, wherein the actuator is selectively driven by the pressurized hydraulic fluid thereby operating the target devic; an accumulator hydraulically connected to the pump for collecting pressurized hydraulic fluid; and a pilot valve hydraulically connected between the accumulator and the actuator, wherein the pilot valve selectively routes pressurized hydraulic fluid to the actuator.

24. A hydraulic actuation system comprising: a motor configured to receive a time varying signal delivered along a piping structure; a pump for pressurizing a hydraulic fluid, the pump being operably connected to and being driven by the motor; an actuator hydraulically connected to the pump and configured for operable attachment to a target device, wherein the actuator is selectively driven by the pressurized hydraulic fluid, thereby operating the target device; an accumulator hydraulically connected to the pump for collecting pressurized hydraulic fluid; a pilot valve hydraulically connected between the accumulator and the actuator, wherein the pilot valve selectively routes pressurized hydraulic fluid to the actuator; wherein an electrically insulating joint is positioned on the pipe member, wherein an induction choke is positioned around the pipe member; and wherein the time varying current is routed along the pipe member between the electrically insulating joint and the induction choke.

* * * * *